United States Patent [19]

Maasberg et al.

[11] 4,218,961

[45] Aug. 26, 1980

[54] LUBRICATING SYSTEM FOR HIGH-PRESSURE PUMP

[75] Inventors: Wolfgang Maasberg, Hünxe-Krudenburg; Adalbert Huperz, Hockenheim, both of Fed. Rep. of Germany

[73] Assignee: Woma-Apparatebau Wolfgang Maasberg & Co. GmbH, Duisburg, Fed. Rep. of Germany

[21] Appl. No.: 954,549

[22] Filed: Oct. 25, 1978

[30] Foreign Application Priority Data

Oct. 26, 1977 [DE] Fed. Rep. of Germany ..... 2747843

[51] Int. Cl.[2] ..... F01B 31/10

[52] U.S. Cl. ..... 92/156; 92/157; 92/160; 417/568

[58] Field of Search ..... 92/156, 157, 158, 159, 92/160; 184/6.5, 6.6; 123/196 M

[56] References Cited

U.S. PATENT DOCUMENTS

| | | | |
|---|---|---|---|
| 878,783 | 2/1908 | Downie | 92/157 |
| 921,129 | 5/1909 | Link | 92/157 |
| 2,095,692 | 10/1937 | Everheart | 92/156 |
| 2,380,907 | 7/1945 | Hall | 92/157 |

*Primary Examiner*—Paul E. Maslousky

*Attorney, Agent, or Firm*—Karl F. Ross

[57] ABSTRACT

A high-pressure pump has a housing whose cylindrical chamber is subdivided by a piston into a fixed-volume compartment and a variable-volume compartment. An orbital crank is connected via a connecting rod to this piston to reciprocate it in the housing and thereby cyclically increase and decrease the volume of the variable-volume compartment. This variable-volume compartment is connected via a downstream conduit and a checkvalve to a supply of liquid lubricant, and to an upstream conduit and an upstream checkvalve both to the fixed-volume compartment and to the joints or bearings at the end of the connecting rod.

11 Claims, 3 Drawing Figures

LUBRICATING SYSTEM FOR HIGH-PRESSURE PUMP

FIELD OF THE INVENTION

The present invention relates to a lubricating system for a high-pressure pump. More particularly this invention concerns such a system usable in a piston pump having a horizontally reciprocal piston.

BACKGROUND OF THE INVENTION

A high-pressure pump such as described in our commonly assigned and copending patent application Ser. No. 948,542 has a piston which is normally rapidly reciprocated in relatively short strokes by a connecting rod whose end is secured to an orbital crank for transmitting the rotary orbital motion of the crank into a reciprocating motion of the piston.

As such a piston is normally reciprocated at very high speed it is essential that all of the various sliding-contact and rolling-contact surfaces be well lubricated. Thus it is necessary to provide a lubricant film around the piston in the chamber, as well as over the ends of the connecting rod, both at the piston and at the crank. Normally such lubrication is effected by providing a separate lubricating pump connected to an independent supply of fluid and to tubing or conduits connected to or opening at the various parts to be lubricated. This separate pump continuously circulates the lubricant over the regions to be lubricated and is normally connected up so as to operate whenever the pump is operated.

Such a system is relatively complex and, therefore, contributes considerably to the cost of the pump that is employed. Furthermore such arrangements make the pump considerably more bulky, and the extra tubing, lubricant pump, and other associated parts of the system constitute structural elements which increase the likelihood of failure, as any failure of the lubricating systen will normally result in rapid destruction of the pump by overheating.

OBJECTS OF THE INVENTION

It is therefore an object of the present invention to provide an improved pump.

Another object is the provision of an improved lubricating system for a high-pressure pump.

A further object is to provide such a lubricating system which is relatively simple and compact.

SUMMARY OF THE INVENTION

These objects are attained according to the instant invention in a piston pump whose piston has a shoulder defining in the cylinder chamber of the housing containing the piston a variable-volume pumping compartment. A supply holding a body of liquid lubricant is connected via an upstream conduit to this variable-volume compartment which is in turn connected via a downstream conduit to the ends of the connecting rods secured between the piston and the orbital crank that operates it. Upstream and downstream checkvalves are provided in the upstream and downstream conduits so that when the drive orbits the crank and thereby cyclically increases and decreases the volume of the variable-volume compartment the lubricant is pumped through the upstream conduit, through the variable-volume compartment, and through the downstream conduit to the ends of the connecting rod.

Thus the system according to the instant invention totally eliminates the need of a separate lubricant pump, using the reciprocating piston of the high-pressure pump to circulate its own lubricant. As a result any of the problems that can possibly result from the failure of the lubricating pump are eliminated.

According to another feature of this invention the piston is formed with at least one second shoulder that forms with the cylinder a fixed-volume compartment of cylindrically annular shape surrounding the piston between the shoulders. This fixed-volume compartment is connected to the downstream conduit and is, therefore, similarly filled with lubricant pumped out of the variable-volume compartment. The liquid in this fixed-volume compartment will therefore coat the interior of this cylinder and ensure proper lubrication of the piston therein.

In accordance with another feature of this invention the piston itself may be formed with at least one throughgoing passage constituting part of the downstream conduit. This passage opens via radial bores at the variable-volume compartment. The downstream checkvalve to provided directly in the piston and the radial bores or branches connect an axially extending part of this passage with the fixed-volume compartment. The rear or downstream member of this passage opens up at the ball-and-socket or swivel joint connecting the head of the connecting rod to the piston. This connecting rod is in turn formed with the longitudinally throughgoing passage that communicates with the passage of the piston and opens at its far end at the crank for lubricating the bearing or journal provided at this crank. With such an arrangement fluid is sucked into the variable-volume compartment and then pumped through the piston and through the connecting rod to all of the surfaces needing lubrication. As no outside conduits are provided the arrangement is extremely compact and well protected.

Although it is desired to mount the downstream checkvalve outside the housing it is possible according to a further feature of this invention to provide external conduits constituting the downstream conduit and connecting the two compartments together. Such an external conduit may also be connected with a pressure-regulating valve also connected back to the liquid lubricant supply for maintaining a predetermined superatmosphere pressure in the downstream conduit. It is also possible to provide a filter in the conduit between the two compartments and to provide a cooler between the pressure-regulating valve and the sump.

Thus the system according to the instant invention allows an extremely compact and, indeed, integral lubricating arrangement to be provided for a high-pressure piston pump. Little extra structure need be added in order to provide an extremely efficient and simplified lubricating system that will automatically circulate lubricant through the pump at a rate dependent upon operational speed. If the pump is not operating the lubricant will not be unnecessarily pumped, although when a pressure-regulating valve is provided it is possible to retain some pressure inside the lubricating system. The possibility of building the lubricating pump in an arrangement almost completely inside the pump ensures that damage from outside of these partss so necessary for the proper operation of the pump will be almost impossible.

SPECIFIC DESCRIPTION

Figure 1:
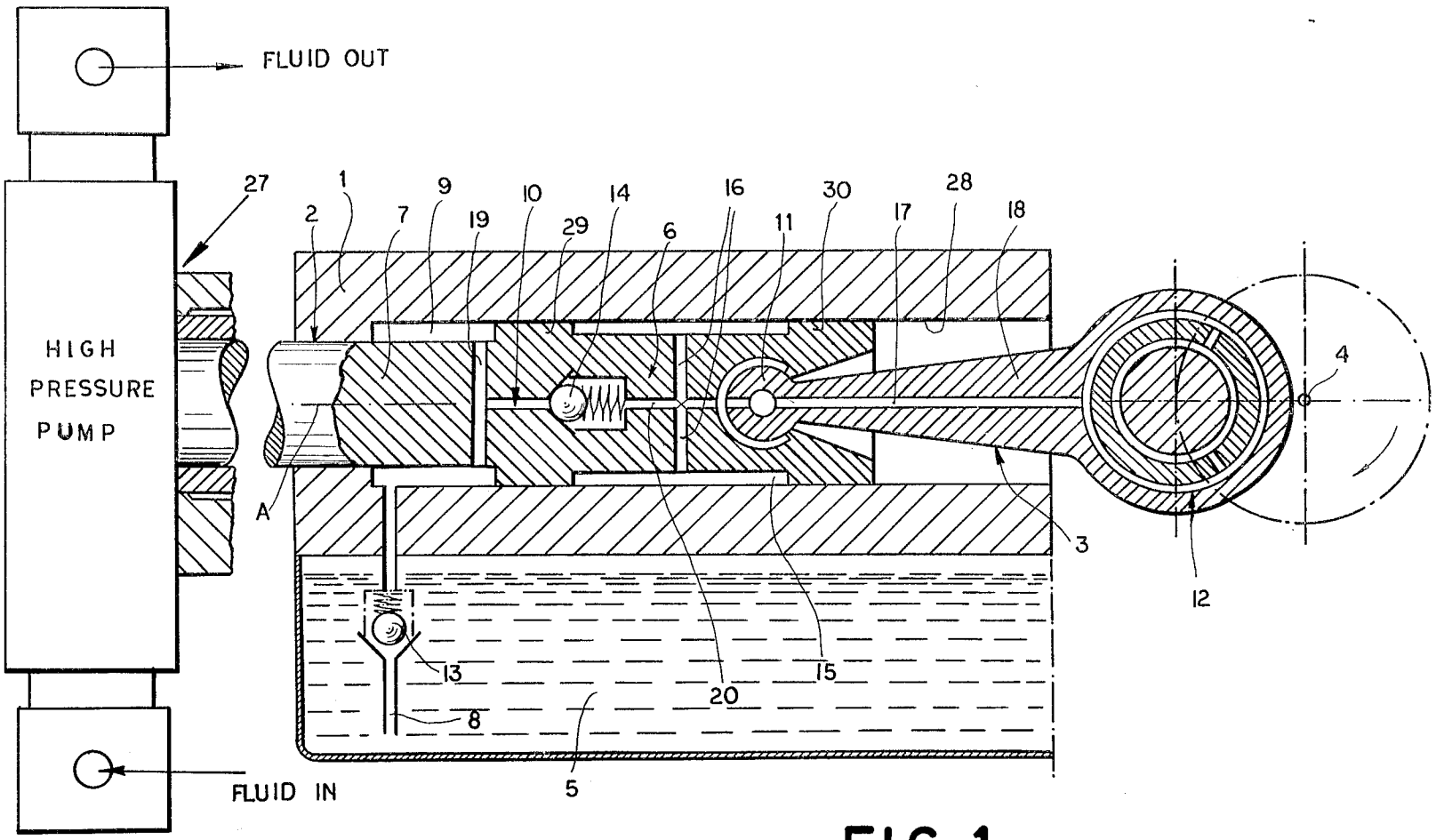
FIG. 1 is an axial section through a pump according to this invention.

As shown in FIG. 1 a pump according to this invention has a housing 1 in which a piston 2 is displaceable along an axis A. This piston operates a pump and valve head 27 such as shown and described in detail in our above-cited copending application.

According to this invention the piston 2, which is formed substantially as a body of revolution about the axis A, is operated by a connecting rod 3 carried on a crank 4. Rotation of the crank 4 about an axis perpendicular to the axis A reciprocates the piston 2 back and forth along the axis A inside a cylindrical chamber 28 formed inside the housing 1.

Provided underneath this housing 1 is a reservoir 5 holding a body of lubricant, here oil. The piston 2 has an intermediate shoulder 29 and a rear shoulder 30 defining between themselves a portion 6 of relatively large diameter. The shoulder 29 defines in front of itself a portion 7 of somewhat smaller diameter. An intake or downstream conduit 8 provided with a checkvalve 13 connects the reservoir 5 with a chamber 9 defined between the small-diameter front portion 7 and the inner wall of the chamber 28 forming the housing 1. A downstream conduit generally indicated at 10 extends between this compartment 9 and the swivel joint 11 at the one end of the connecting rod 3 as well as to the bearing 12 at the end of the connecting rod 3 connected to the crank 4. A downstream checkvalve 14 is provided inside the piston 2 in the conduit 10.

The portion 6 between the shoulders 29 and 30 defines a fixed-volume compartment 15 that communicates via radial bores 16 with an axial bore 20 constituting part of the conduit 10. The front portion of this bore 20 connects to a diametral bore 19 opening into the compartment 9. Similarly the intermediate portion 18 of the connecting rod 3 is formed with a longitudinally extending passage 17 constituting the downstream end of the downstream conduit 10.

Thus with the system according to the instant invention as the piston 2 reciprocates volume of the compartment 9 will cyclically increase and decrease. As the volume of compartment 9 increases liquid will be aspirated from the supply 5 into the compartment 9 through the checkvalve 13, while the checkvalve 14 remains closed. When the piston is advanced, toward the left in FIG. 1, and the volume of compartment 9 decreases the checkvalve 13 will close and the checkvalve 14 will open so that the aspirated lubricating oil will be forced under pressure through the passages 19, 20, and 16 into the chamber 15 as well as to the end 11, and through the passage 17 to the end 12 of the connecting rod 3. Fluid that drains out of the ends 11 and 12 will flow automatically back into the supply 5 in a manner well known in the art.

Figure 2:
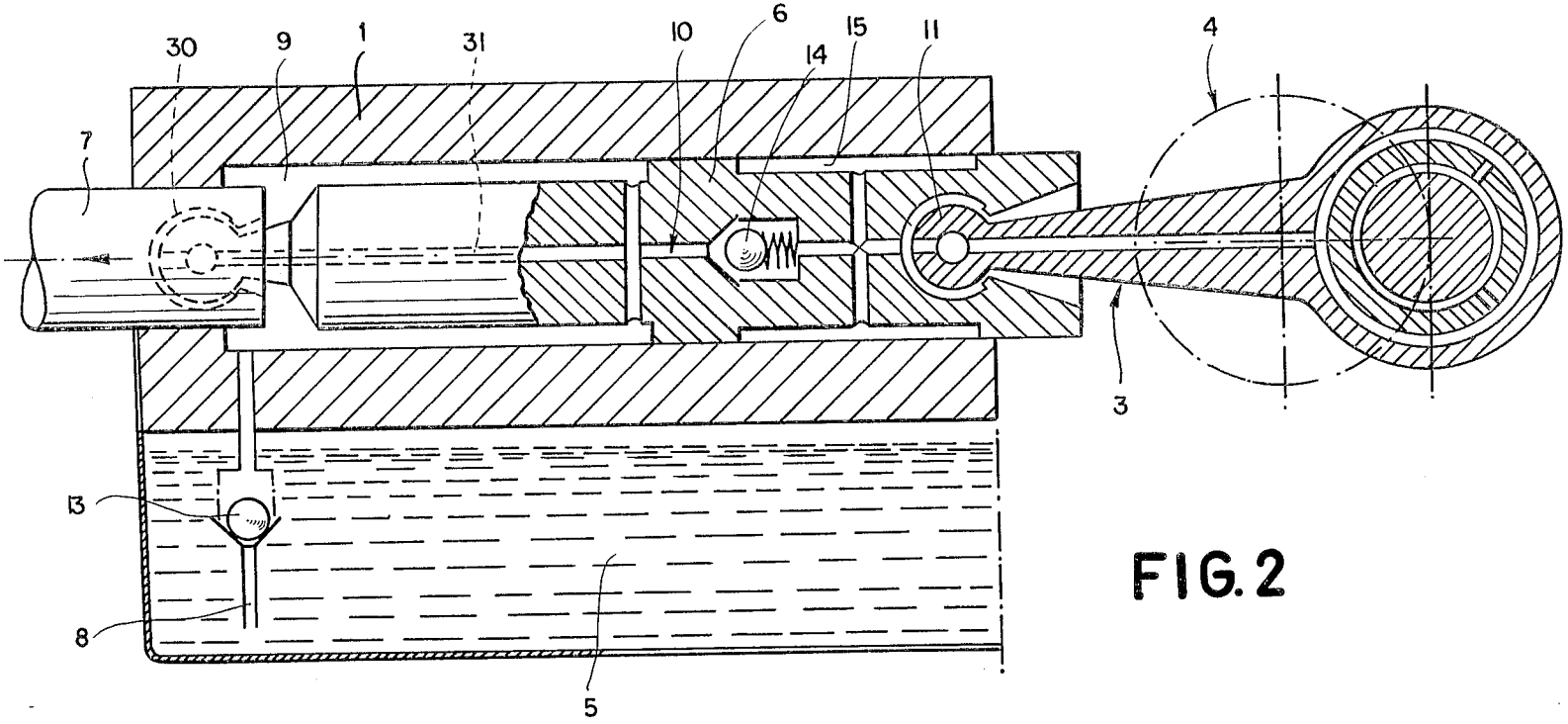
FIG. 2 is a view similar to FIG. 1 showing the pump in an alternate position and somewhat modified.

It is also possible as shown in FIG. 2 for the piston 2 to be provided at its front end with a ball-and-socket joint 30 connected via an axial bore 31 to the conduit 10. Thus this joint 30, which prevents nonaxial forces from being imparted to the piston 2, will also be lubricated.

Figure 3:
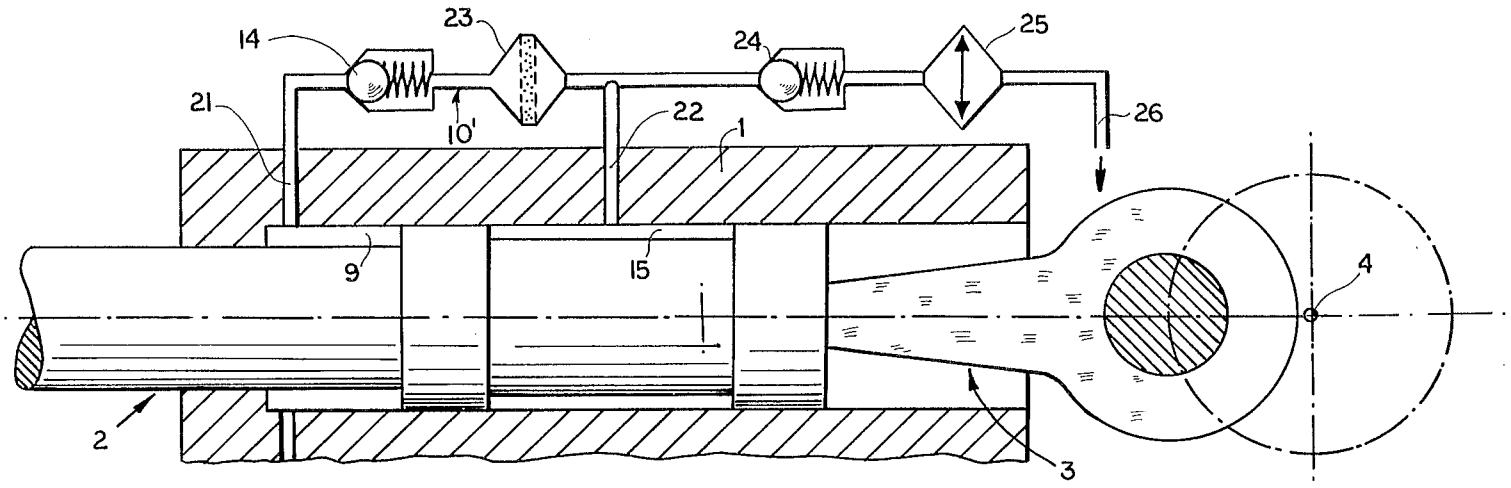
FIG. 3 is a view similar to FIGS. 1 and 2 showing another view of a pump according to this invention.

FIG. 3 shows another arrangement identical to that of FIG. 1 but wherein the upstream half of the passage 20 is eliminated. Instead a pair of conduits or pieces of tubing 21 and 22 constituting a downstream conduit 10′ extend radially out of the housing 1. The conduit 21 is connected via the checkvalve 14 and a filter 23 to the conduit 22. In addition this system has a pressure-regulating valve 24 and a cooler 25 that are connected to a return line 26 that leads back to the supply 5. This regulating valve 24 prevents the pressure inside the downstream conduit 10′ from exceeding a predetermined maximum, since it opens whenever this maximum is exceeded. The extra flowing through the valve 24 is cooled for low operating temperature of the pump.

I claim:

1. A pump comprising:
- a housing defining a cylinder chamber;
- a piston reciprocal in said chamber and formed with at least one shoulder defining in said chamber a variable-volume pumping compartment;
- an orbital crank;
- a connecting rod having one end connected to said crank and another end connected to said piston;
- a supply holding a body of liquid lubricant;
- an upstream conduit between said supply and said variable-volume compartment;
- an upstream check valve in said upstream conduit permitting fluid flow therein only from said supply to said variable-volume compartment;
- a downstream conduit extending from said variable-volume compartment to both ends of said connecting rod;
- a downstream check valve in said downstream conduit between said ends of said connecting rod and said variable-volume compartment; and
- drive means for orbiting said crank and thereby cyclically increasing and decreasing the volume of said variable-volume compartment for pumping said lubricant through said upstream conduit, through said variable-volume compartment, and through said downstream conduit to said ends of said connecting rod.

2. The pump defined in claim 1 wherein said piston is formed internally with a throughgoing passage provided with said downstream valve and constituting at least part of said downstream passage.

3. The pump defined in claim 1 wherein said piston is formed with at least one other shoulder defining with said housing in said chamber a fixed-volume lubricating compartment independent of said variable-volume pumping compartment and connected to said downstream conduit.

4. The pump defined in claim 3 wherein said passage has a branch extending into said fixed-volume compartment and also leads to said other end of said connecting rod.

5. The pump defined in claim 4 wherein said connecting rod is formed with a throughgoing passage between its ends constituting part of said downstream conduit.

6. The pump defined in claim 3 wherein said piston is of smaller diameter at said variable-volume compartment than at said fixed-volume compartment.

7. The pump defined in claim 3 wherein said downstream conduit has a portion extending externally of said housing between said compartments, said downstream valve being in said portion, said passage extending between said fixed-volume compartment and said other end of said piston.

8. The pump defined in claim 1, further comprising a pressure-regulating valve connected between said downstream conduit and said supply for maintaining a predetermined superatmospheric pressure in said downstream conduit.

9. The pump defined in claim 8, further comprising a cooler for said lubricant and a filter for said lubricant connected to said downstream conduit.

10. The pump defined in claim 1 wherein said piston has an end opposite said connecting rod and provided with a ball-and-socket joint, said downstream conduit being connected to said joint.

11. The pump defined in claim 1 wherein said shoulder and said variable-volume compartment are annular and circumferentially surround said piston.

* * * * *